US006148651A

United States Patent [19]

Roncin

[11] Patent Number: 6,148,651

[45] Date of Patent: Nov. 21, 2000

[54] MOTOR VEHICLE DOOR LOCK

[75] Inventor: Jean-Michel Roncin, Abbeville, France

[73] Assignee: Valeo Securite Habitacle, Creteil, France

[21] Appl. No.: 09/296,527

[22] Filed: Apr. 22, 1999

[30] Foreign Application Priority Data

Apr. 30, 1998 [FR] France ..... 98 05492

[51] Int. Cl.[7] ..... E05B 53/00

[52] U.S. Cl. ..... 70/264; 292/201; 292/DIG. 23

[58] Field of Search ..... 70/264, 279.1, 70/277; 292/201, 216, DIG. 23

[56] References Cited

U.S. PATENT DOCUMENTS

| | | | |
|---|---|---|---|
| 4,667,990 | 5/1987 | Quantz | 292/201 |
| 5,409,277 | 4/1995 | Rogers, Jr. et al. | 292/336.3 |
| 5,474,338 | 12/1995 | Buscher | 292/201 |
| 5,577,782 | 11/1996 | Johnson et al. | 292/216 |
| 5,634,677 | 6/1997 | Buscher et al. | 292/216 |
| 5,636,879 | 6/1997 | Tanaka et al. | 292/2 |
| 5,667,263 | 9/1997 | Kleefeldt et al. | 292/336.3 |
| 5,722,272 | 3/1998 | Bridgeman et al. | 70/264 |
| 5,901,991 | 5/1999 | Hugel et al. | 292/201 |
| 5,951,070 | 9/1999 | Spurr | 292/201 |
| 5,997,055 | 12/1999 | Strathmann | 292/201 |
| 6,000,257 | 12/1999 | Thomas | 70/279.1 |

FOREIGN PATENT DOCUMENTS

| | | | |
|---|---|---|---|
| 0 426 535 A1 | 5/1991 | European Pat. Off. . | |
| 0 478 013 A2 | 4/1992 | European Pat. Off. . | |
| 2262769 | 6/1993 | United Kingdom | 292/201 |

*Primary Examiner*—B. Dayoan
*Assistant Examiner*—Clifford B Vaterlaus
*Attorney, Agent, or Firm*—Pollock, Vande Sande & Amernick

[57] ABSTRACT

Motor vehicle door lock having a means of locking/unlocking the lock from the outside and an electric actuator (50) for controlling the means of locking/unlocking from the outside. In particular, the means of locking/unlocking from the outside is a central locking/unlocking wheel (20) with which all the means (22, 38, 40) of controlling the locking/unlocking of the lock from the outside cooperate. Also, the wheel can be rotated by the electric actuator (50).

20 Claims, 5 Drawing Sheets

MOTOR VEHICLE DOOR LOCK

The present invention relates to a motor vehicle door lock, and in particular a door lock in which the locking/unlocking is controlled electrically and opening is controlled mechanically.

At the present time, motor vehicle door locks generally consist of three superimposed compartments: a first compartment containing the retaining elements of the lock, namely, in particular, a latch and a pawl for blocking the latch, a slot being formed in the first compartment to allow a door striker to engage with the latch of the lock; a second compartment containing the motion-transmission mechanisms for opening and locking/unlocking the lock, with which are associated the linkages for opening from the inside and from the outside, together with the toggle of a barrel in the case of a front door lock; a third compartment containing an electric actuator for controlling the locking/unlocking of the lock, by acting on the mechanisms in the second compartment.

The motion transmission mechanisms contained in the second compartment are generally complicated and employ a great many parts, which increases the cost of manufacture and makes assembly more complicated.

A first object of the invention is to propose a motor vehicle door lock that employs a reduced number of components, and which is simpler to assemble.

For safety reasons, the locks of the front doors of motor vehicles must allow the lock to be both opened and unlocked when the user operates the internal door handle. By contrast, in the case of locks for rear doors, a child lock device is generally provided to block the opening of the rear door and thus prevent a child from accidentally falling out of the vehicle while it is travelling along if it actuates the internal door handle. The rear doors are also fitted with a lock stalk for locking/unlocking the rear door lock from inside the cabin of the vehicle. The conflicting safety requirements of the front and rear doors of a motor vehicle mean that two different types of lock have to be manufactured, and this increases the cost of manufacture.

A second object of the invention is to provide a motor vehicle door lock which is just as well suited to a front door as it is to a rear door.

When a lock in which locking/unlocking is controlled electrically, is used, if the vehicle battery and any backup batteries are flat or dead, it needs to be possible to lock all the doors of the vehicle mechanically, for example if the vehicle is to be left to go and seek assistance. In the case of the front doors, the locks can be locked with a key, because the front locks have a barrel. In the case of the rear doors, there is currently a locking stalk for locking the lock from the inside, because the rear locks do not have barrels.

The third object of the invention is to propose a motor vehicle door lock in which the locking/unlocking is controlled electrically and which allows the rear door locks to be locked in the absence of lock stalks.

The third compartment of the lock generally contains an electric actuator housed in its own housing which is inserted in slideways on the housing of the second compartment, together with a number of parts which provide the connection between the actuator and the lock stalk for controlling the locking/unlocking means inside the second compartment, the entire third compartment being covered by an additional cover.

The fourth object of the invention is to propose a door lock in which the connection between the actuator and the locking/unlocking means inside the second compartment is simplified, the number of parts used in the third compartment is reduced and the third compartment is simpler to assemble.

To this end, the first subject of the invention is a motor vehicle door lock comprising a means of locking/unlocking the lock from the outside, and an electric actuator for controlling the said means of locking/unlocking from the outside, characterized in that the said means of locking/unlocking from the outside is a central locking/unlocking wheel with which all the means of controlling the locking/unlocking of the lock from the outside cooperate, it being possible for the said wheel to be rotated by the electric actuator.

In one particular embodiment, the lock comprises a lock pawl blocking a lock latch at rest in a position which can retain a door striker in a door-closed position, and a link rod for opening from the outside capable of moving, under the action of an external door handle, into contact with an active portion of the said pawl to move it into a retracted position releasing the latch, which allows the door to be opened, said wheel cooperating with the link rod for opening from the outside to move it, as the said wheel rotates, between an engaged stable position in which the link rod for opening from the outside comes into contact with the said active portion of the pawl, during its door-opening travel, and a disengaged stable position in which the link rod for opening from the outside no longer comes into contact with the pawl during its door-opening travel.

In the case of a front door lock, it is possible to ensure that the said wheel cooperates with a toggle operating lever which is able to rotate the said wheel under the action of a lock barrel toggle to move the link rod for opening from the outside between its disengaged and engaged positions.

Advantageously, the toggle operating lever is coupled to the said wheel with freedom of circular translational movement that corresponds to the angular travel of the said wheel under the action of the actuator so that the movement of unlocking/locking the wheel using the electric control of the actuator does not interfere with the movement of unlocking/locking the wheel using the mechanical control of the barrel, the toggle operating lever having two positions of simple contact with the said wheel to move it either into its unlocked position when it is in its locked position or into its locked position when it is in its unlocked position. In this case, the connection between the toggle operating lever and the said wheel may be formed by the coupling of a fork with a protruding stub, the branches of the said fork being spaced apart by a distance that corresponds to the angular travel of the wheel under the action of the actuator.

According to another feature the link rod for opening from the outside is coupled to the wheel with freedom to move in the direction of the opening travel of the said link rod, for example by appropriate coupling between a fork and a protruding stub.

In another particular embodiment, the lock comprises a lever for opening from the inside which is intended to move a link rod for opening from the inside under the action of an internal door handle, into contact with an active portion of the pawl to move it into a retracted position, the said lever for opening from the inside cooperating, in its door-opening travel, with the said wheel to rotate it into its unlocked position. For example, the connection between the lever for opening from the inside and the said wheel is formed by a simple contact only causing the said wheel to move into its unlocked position, the lever for opening from the inside being returned to its position of rest independently of the said wheel. Thus, using the internal door handle it is possible, from inside vehicle cabin, to unlock the door as far as opening it from the outside is concerned, which is particularly advantageous in the case of a rear door which is fitted with a child lock that is in operation. Of course, if the wheel is already in its unlocked position, the lever for opening from the inside will act but have no effect on the wheel.

According to another feature, the wheel has a number of stubs protruding at right angles to its plane to cooperate with the various means of controlling locking and/or unlocking from the outside.

Advantageously, the actuator consists of an electric motor, the driveshaft of which rotates a drive pinion which meshes tangentially with a gearwheel, the rotation axle of which is perpendicular to the axis of the pinion and secured to the aforementioned central locking/unlocking wheel.

According to yet another feature, the actuator is connected to a three-position switch which comprises a trigger arm pivoting between two stops which are positioned on the toggle operating lever to transmit the locking/unlocking information to the actuator of another lock. Thus, if the user locks/unlocks a front door lock by inserting a key into the barrel, the actuators of the other door locks will be informed by the switch of this lock/unlock command and will act on their respective lock to place all the locks in the same state.

The second subject of the invention is a motor vehicle door lock comprising a lock pawl blocking a lock latch at rest in a position in which it can retain a door striker in a door-closed position, and a link rod for opening from the outside capable of moving, under the action of an internal door handle, into contact with an active portion of the said pawl to move it into a retracted position releasing the latch, which allows the door to be opened, characterized in that it comprises a child lock means for moving the said link rod between a disengaged stable position in which the link rod no longer comes into contact with the pawl, during its door-opening travel, and an engaged stable position in which the link rod comes into contact with the said active portion of the pawl during its door-opening travel.

Advantageously, the child lock means cooperates with the link rod for opening from the inside to move it between disengaged and engaged positions in a direction roughly perpendicular to the link rod-opening travel so that the movement of engaging/disengaging the link rod does not interfere with its opening travel.

In a first embodiment, the child lock means is a child lock lever articulated about an axle on the housing, one end of the lever cooperating with the link rod, while another end is accessible on the edge of the door.

As a preference, the connection between the child lock lever and the link rod for opening from the inside is formed by the coupling between a fork and a protruding stub, the stub being free to slide in the fork in the direction of the link rod-opening travel.

In another embodiment, the child lock means comprises a child lock knob mounted so that it can rotate on the housing and accessible on the edge of the door, and an intermediate lever connecting the knob to the link rod for opening from the inside to move it between the disengaged and engaged positions as the knob is turned. In this case, the connection between the intermediate lever and the link rod for opening from the inside is preferably formed by the coupling between an oblong slot and a protruding stub, the said stub being free to slide in the slot in the direction of the link rod-opening travel.

Of course, it would also be possible, as an alternative, to envisage an additional electric actuator for driving the link rod for opening from the inside between its disengaged and engaged positions under the action of a control means situated, for example, on the vehicle dashboard.

According to another feature, the lock comprises a link rod for opening from the outside capable of moving, under the action of an external door handle, into contact with an active portion of the pawl to move it into the retracted position, and a means of locking/unlocking from the outside to move the link rod for opening from the outside between a disengaged position in which the link rod for opening from the outside no longer comes into contact with the pawl during its door-opening travel, and an engaged position in which the link rod for opening from the outside comes into contact with the said active portion of the pawl during its door-opening travel.

Advantageously, the lock comprises a lever for opening from the inside which is intended to move the link rod for opening from the inside through its opening travel under the action of an internal door handle, the said lever for opening from the inside cooperating with the said means of locking/unlocking from the outside so as to cause the link rod for opening from the outside to move into its engaged position during the opening travel of the lever for opening from the inside, the lever for opening from the inside returning to its position of rest independently of the means of locking/unlocking from the outside.

Thus, in a rear door lock, all that is required is for the link rod for opening from the inside to be placed in the disengaged position in order to obtain the child lock function, without this in any way blocking the opening travel of the link rod for opening from the inside, which makes it possible to unlock the rear door as far as being opened from the outside is concerned when the internal handle of a rear door is operated, the lever for opening from the inside cooperating with the means of locking/unlocking from the outside. In the case of a front door lock, all that is required is for the child lock means to be placed in a position in which the link rod for opening from the inside is in an engaged position, which does not alter the structure of the lock which remains the same for the front as for the rear.

According to yet another feature, the lock comprises a return spring common to both link rods—the one for opening from the inside and the one for opening from the outside—to return them to their position of rest when they have been moved through their respective opening travel, the said common return spring being fixed at an intermediate point to the lock housing, one end of the said common return spring cooperating with the link rod for opening from the inside, while an opposite end of the common return spring cooperates with the link rod for opening from the outside. Advantageously, each link rod comprises two notches in which the respective end of the common return spring can engage, engagement of the spring in each notch corresponding respectively to a disengaged or to an engaged position of the link rod, which thus defines a bistable common return spring.

The third subject of the invention is a motor vehicle door lock comprising a lock pawl blocking a lock latch at rest in a position in which it can retain a door striker in a door-closed position, a link rod for opening from the inside and a link rod for opening from the outside which are capable of moving, under the respective action of an internal door handle and of an external door handle, into contact with an active portion of the said pawl to move it into a retracted position releasing the latch, which allows the door to be opened and an electric actuator for controlling the locking/unlocking of the door from the outside, characterized in that it comprises a mechanically controlled emergency locking means for moving the link rod for opening from the inside in such a way that a portion thereof comes into contact with the link rod for opening from the outside and moves it into a disengaged stable position in which the link rod for opening from the outside no longer comes into contact with the said active portion of the pawl during its opening travel. This emergency locking mechanical means is particularly advantageous in the case of a rear door lock, given that, at the front, locking can be achieved, even in the event of an electrical failure, using the lock barrel.

Advantageously, the two aforementioned link rods are arranged one on each side of the said active portion of the pawl, so that they can come into contact simultaneously or not with the said active portion of the pawl, without the respective opening travels of the link rods interfering with one another.

In one particular embodiment, the lock comprises a mechanically controlled child lock means accessible on the edge of the door, for moving the link rod for opening from the inside between a disengaged stable position in which the link rod for opening from the inside no longer comes into contact with the pawl during its door-opening travel, and an engaged stable position in which the link rod for opening from the inside comes into contact with the said active portion of the pawl during its door-opening travel, it being possible for the link rod for opening from the inside to be moved over a further travel by the child lock means which forms the aforementioned emergency locking means.

Advantageously, the child lock means cooperates with the link rod for opening from the inside to move it between the disengaged and engaged positions in a direction roughly perpendicular to the link rod for opening from the inside opening travel so that the movement of engaging/disengaging the said link rod does not interfere with its opening travel.

In a first embodiment, the child lock means is a child lock lever articulated about an axle on the housing, one end of the lever cooperating with the link rod for opening from the inside, while another end is accessible on the edge of the door.

As a preference, the connection between the child lock lever and the link rod for opening from the inside is formed by the coupling between a fork and a protruding stub, the stub being free to slide in the fork in the direction of the link rod for opening from the inside opening travel.

In a second embodiment, the child lock means comprises a child lock knob mounted so that it can rotate on the housing and accessible on the edge of the door, and an intermediate lever connecting the knob to the link rod for opening from the inside to move it between the disengaged and engaged positions as the knob is turned. In this case, the connection between the intermediate lever and the link rod for opening from the inside is preferably formed by the coupling between an oblong slot and a protruding stub, the said stub being free to slide in the slot in the direction of the link rod for opening from the inside opening travel.

Advantageously, the rotary child lock knob comprises an elastic return means for returning it to its position of rest when the child lock knob has been moved over its further travel.

According to yet another feature, the lock comprises a return spring common to both link rods—the one for opening from the inside and the one for opening from the outside—to return them to their position of rest when they have been moved through their respective opening travel, the said common return spring being fixed at an intermediate point to the lock housing, one end of the said common return spring cooperating with the link rod for opening from the inside, while an opposite end of the common return spring cooperates with the link rod for opening from the outside. Advantageously, each link rod comprises two notches in which the respective end of the common return spring can engage, engagement of the spring in each notch corresponding respectively to a disengaged or to an engaged position of the link rod, which thus defines a bistable common return spring.

Advantageously, the link rod for opening from the inside comprises a ramp along which the corresponding end of the common return spring travels during the further travel of the child lock means, the said ramp being designed to define an unstable position of the link rod for opening from the inside, which link rod is returned to one of its stable engaged or disengaged positions by the said corresponding end of the common return spring.

According to yet another feature, the link rod for opening from the inside comprises a protrusion towards the link rod for opening from the outside so as to come into contact with the latter when it has been moved under the action of the emergency locking means. As a preference, the said protrusion is designed not to come into contact with the link rod for opening from the outside when the link rods move between their respective disengaged and engaged positions.

According to a first alternative feature, the link rod for opening from the inside moves, when the child lock means is moved over its further travel, beyond its engaged stable position and remains in the engaged position throughout the further travel.

According to a second alternative feature, the link rod for opening from the inside moves, when the child lock means is moved over its further travel, beyond its disengaged stable position and remains in the disengaged position throughout the further travel.

The fourth subject of the invention is a motor vehicle door lock comprising a cable or linkage for opening from the inside and an electric actuator for controlling the locking/unlocking of the lock from the outside, characterized in that it comprises a casing in which the actuator is housed, there being a chimney protruding from the casing for the passage of the linkage or cable for opening from the inside, so as to protect it from possibly being caught hold of via a door window seal.

According to another feature, the casing has an external fin which is inclined downwards and some distance from the lock to deflect the water which has got in through the door window seal away from the internal mechanisms of the lock.

According to yet another feature, the casing comprises a lug for temporarily securing a linkage for opening from the outside when mounting the lock on the edge of the door, the said linkage for opening from the outside being connected to one end of a lever for opening the lock from the outside and wedged along its length between the said temporary securing lug and an edge of the deflector fin.

According to another feature, the casing has a housing at one end for electrical connection pins of the actuator.

Advantageously, the actuator consists of an electric motor, the driveshaft of which rotates a drive pinion which meshes tangentially with a gearwheel, the rotation axle of which is perpendicular to the axis of the pinion and secured to a central locking/unlocking wheel with which all the means of controlling the locking/unlocking of the lock from the outside cooperate.

According to yet another feature, the actuator is connected to a three-position switch which comprises a trigger arm pivoting between two stops which are positioned on a toggle operating lever to transmit the locking/unlocking information to the actuator of another lock, when a lock barrel toggle moves the said toggle operating lever to bring about the locking/unlocking of the lock. Thus, if the user locks/unlocks a front door lock by inserting a key into the barrel, the actuators of the other door locks will be informed by the switch of this command to lock/unlock and will act on their respective lock to place all the locks in the same state.

Of course, the four subjects of the invention as defined hereinabove may be taken alone or in combination with one another.

To give a better understanding of the various subjects and objects of the invention, a number of embodiments thereof will now be described by way of purely illustrative and non-limiting examples, these embodiments being depicted in the appended drawings.

In these drawings:

FIG. 1 shows the lock in section on a longitudinal vertical plane of a door in which it is intended to be mounted. The lock has three compartments A, B and C superimposed in the longitudinal direction.

Figure 7:
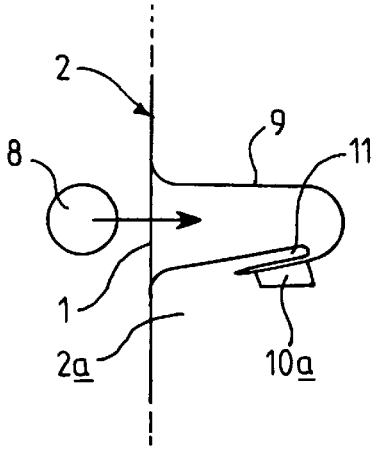
FIG. 7 is a partial diagrammatic view of a door edge fitted with the lock of FIG. 2, illustrating the engagement of a door striker in the slot of the lock.

A detailed description will now be given, referring more specifically to FIGS. 1, 2 and 7, of the first compartment A which contains the retention elements of the lock. Compartment A is defined between a metal backplate 1 which is intended to be positioned on the edge of the door, and a first plastic housing 2 which is mounted on the backplate 1. The compartment A contains a forked latch 3 which is articulated on a stationary axle 4 mounted perpendicularly on the backplate 1. The latch 3 is intended to cooperate with a pawl 5 which is articulated on a stationary axle 6 mounted perpendicularly on the backplate 1. The pawl 5 is returned into contact with the latch 3 by a return spring 7 to block the latch 3 in a closed position to retain a door striker 8 (see FIG. 7). In the position illustrated in FIG. 2, the catch 3 is not blocked in position by the pawl 5, and the opening of its fork faces towards the mouth of the slot 9 to allow the door striker 8 to engage with/disengage from the latch 3.

A stop 10 for keeping the door in position and recentring it in the vertical direction relative to the door striker 8 is mounted on the stationary axle 4 of the latch 3. A portion 10*a* of the stop 10 is flush with the bottom 2*a* of the housing 2, in the region of the slot 9 (see FIG. 7), so that an elastic lug 11 of the bottom 2*a* of the housing 2 covers the said portion 10*a* of the stop 10 to allow the door to be recentred gently with respect to the striker 8.

The backplate 1 comprises, on its opposite edge to the entry to the slot 9, a tab 12 which is curved perpendicularly to the plane of the backplate 1 and comprises, on its internal face that faces towards the latch 3, a protruding portion 12*a* which is roughly V-shaped in vertical cross section and is obtained, for example, by pressing a portion of the plate 12. This protruding metal portion 12*a* is intended to act as a stop for the latch in the transverse direction, when it comes into contact with a thick overmoulding 3*a* formed on one of the branches of the fork of the latch 3.

It will be noted that the door positioning stop 10 does not position the striker in the transverse direction of the door, unlike certain locks of the prior art.

The pawl 5 comprises, at its opposite end 5*a* to its articulation axle 6, at its end in contact with the latch 3, a lug which is produced by overmoulding to damp the pivoting of the pawl 5, under the action of the spring 7, towards the latch 3 by coming up against a portion of the housing 2. The pawl 5 further comprises a lug 13 which is curved in a plane perpendicular to the plane of the backplate 1, to act as an active portion of the pawl intended to be actuated by mechanisms located in the second compartment B for opening and locking/unlocking the lock.

The backplate 1 comprises a number of fixing hole countersinks 14 protruding towards the inside of the compartment A, for the passage of screws for fixing to the door edge (screws not depicted).

The second compartment B which contains the drive and motion-transmission elements of the lock will now be described in detail with reference to FIGS. 1 and 4 to 6. The second compartment B is defined between the bottom 2*a* of the first housing 2 of the first compartment A and a second plastic housing 15, the bottom 15*a* of which acts as a partition from the third compartment C.

Figure 3:
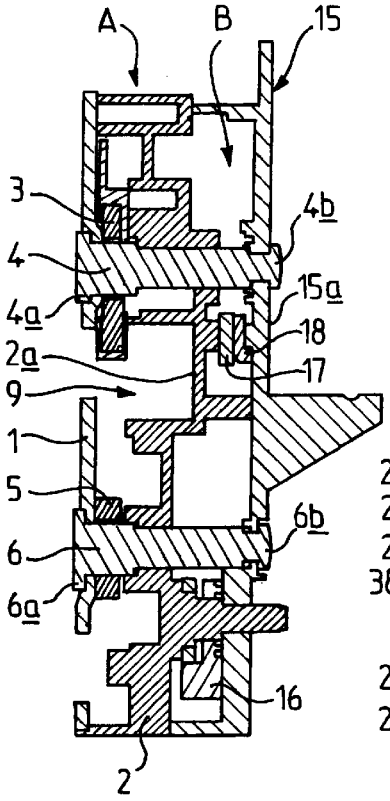
FIG. 3 is a view in section of the first two compartments of a lock of the prior art, in which lock the assembly means have been modified.

FIG. 3 depicts a lock of the prior art, in which only the axles 4 and 6 have been modified. In fact, the axles 4 and 6 have, at one end, a shoulder 4*a,* 6*a* which is intended to come to rest against the external face of the backplate 1, the opposite end 4*b,* 6*b* of the axles being crimped to the bottom 15*a* of the second housing 15, which allows all of the parts of the lock starting from the backplate 1 as far as the third compartment to be assembled without having to turn the lock over in order to crimp the axles at the two ends.

By way of information, the reference numerals 16 to 18 respectively denote a locking lever, a lever for opening from the outside and an intermediate lever of the lock of the prior art.

Figure 1:
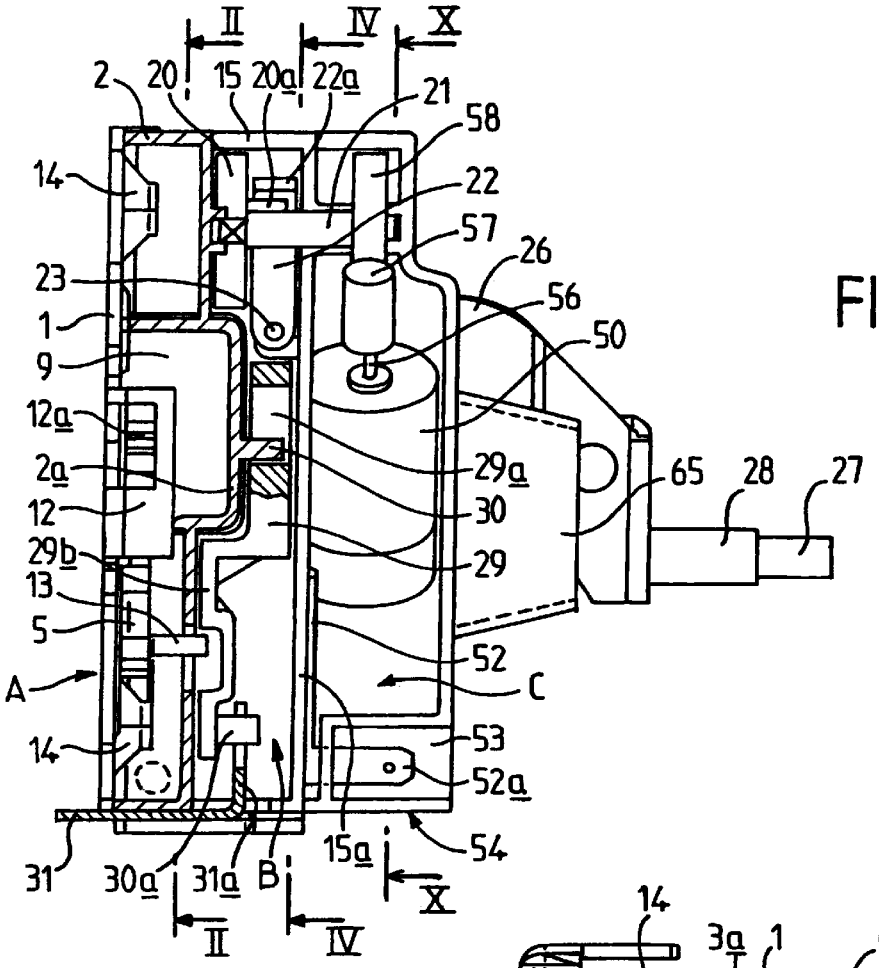
FIG. 1 is a view in section of all three compartments of the lock of the invention, in a longitudinal vertical plane of the door of a motor vehicle, passing near to the entry to the slot, the latch having been omitted.
Figure 4:
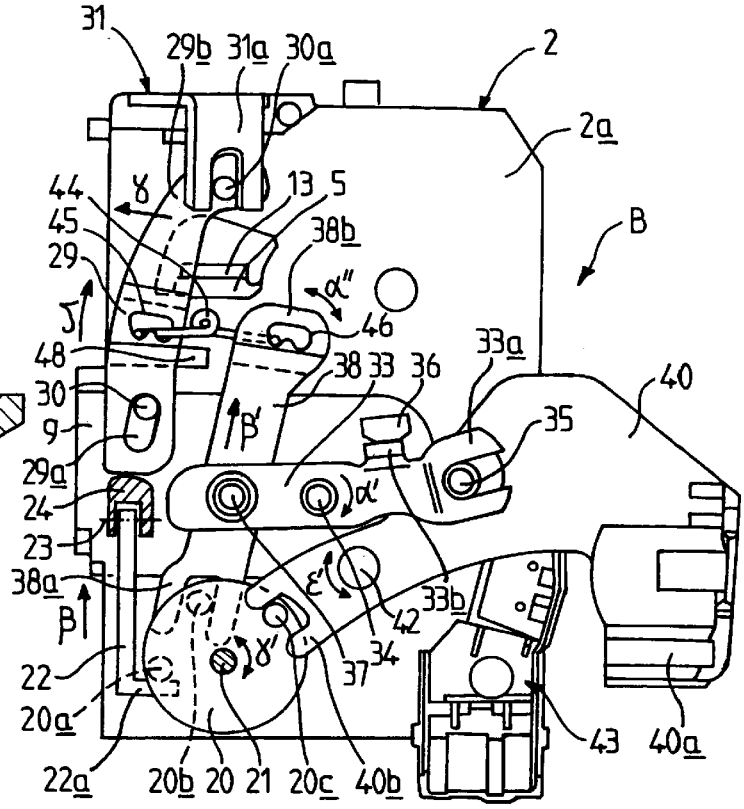
FIG. 4 is a view in section of the second compartment of the lock of FIG. 1 on the line IV, after a rotation through 180° has been made, the link rod for opening from the inside being in its engaged position.

As can be seen in FIGS. 1 and 4, a wheel 20 is mounted so that it can rotate on the bottom 2*a* of the housing 2 about a driveshaft 21 perpendicular to the plane of the bottom 2*a* of the housing 2, the driveshaft 21 passing through the bottom 15*a* of the housing 15 to emerge in the third compartment C, as explained later. The wheel 20 comprises, on its face that faces towards the bottom 2*a* of the housing 2, two stubs 20*a* and 20*b* and, on its face facing towards the bottom 15*a* of the housing 15, a stub 20*c,* the said stubs protruding at right angles to the plane of the wheel 20 and being distributed on its periphery.

Figure 8:
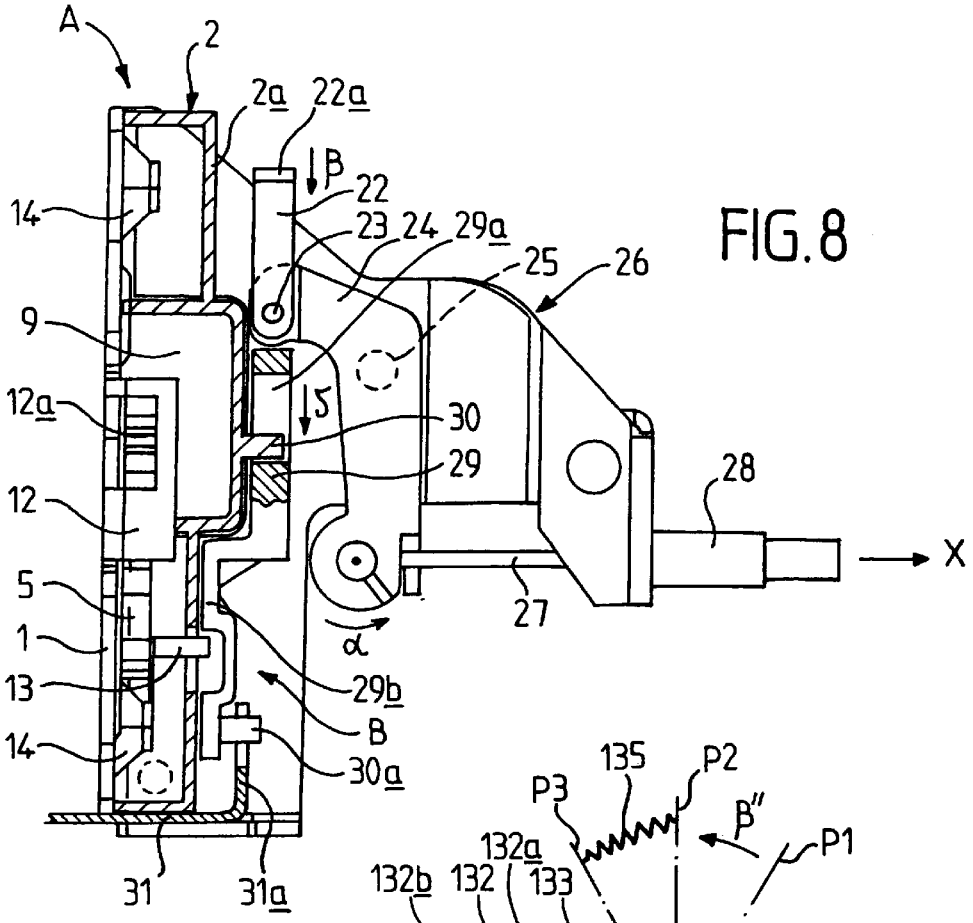
FIG. 8 is a view similar to FIG. 1, the third compartment of the lock and the central locking/unlocking wheel having been omitted.

As visible in FIGS. 1 and 4, the stub 20*a* is in contact with a curved tab 22*a* of an intermediate lever 22 generally known by the name of an over-ride lever. This intermediate lever 22 is articulated on an axle 23 at one end of a lever 24 for opening from the inside. This lever for opening from the inside (LOI) 24 is articulated as a central point on a fixed axle 25 (see FIG. 8) on a roughly flat support flange 26 which extends in the longitudinal direction of the door and is secured to the backplate 1 on the edge where the mouth of the slot 9 lies. The opposite end of the LOI 24 to its end which is articulated to the intermediate lever 22, is articulated to a linkage or cable 27 for opening from the inside which runs in the longitudinal direction of the door and is guided in this direction by a guide sleeve 28 borne by the support flange 26. The cable or linkage 27 for opening from the inside is intended to be connected to an internal door handle or paddle. The LOI 24 is designed to pivot in the direction of the arrow a in FIG. 8, when the cable or linkage 27 for opening from the inside is pulled in the longitudinal direction indicated by the arrow X, to cause a translational movement in the vertical direction over a distance $\beta$ of the intermediate lever 22 so as to cause the wheel 20 to rotate about the axle 21, the curved portion 22*a* of the intermediate lever 22 moving the stub 20*a*. A portion of the cable or linkage 27 for opening from the inside has been indicated diagrammatically in FIGS. 10 to 12, to show its relative position with respect to the third compartment C.

When the LOI 24 is pivoted in the direction of the arrow $\alpha$, its end on which the intermediate lever 22 is articulated is intended to come into contact with a link rod for opening from the inside (LROI) 29 to push it in a roughly vertical direction over a distance indicated by the arrow J. The LROI 29 has an oblong slot 29*a* in which there is engaged, so that it can slide, in the vertical direction, a stud 30 projecting from the bottom 2*a* of the housing 2, to guide and limit the displacement of the LROI 29. The LROI 29 has a stepped end part 29*b* which is intended to come into contact with the bent lug 13 forming the active portion of the pawl 5, as clearly visible in FIGS. 1 and 8. The opposite end of the LROI 29 has a projecting stub 30*a* which is engaged, so that it can slide, in the vertical direction, in an end fork 31*a* of a child lock lever 31. As is better visible in FIG. 4B, the child lock lever 31 is articulated at a central point about an axis 32 on a side wall of the housing 2 extending in the longitudinal direction of the door, so that the end 31*b* of the lever 31, which, with respect to the axis 32, is at the opposite end from the fork 31*a,* is accessible on the edge of the door to allow it to be manipulated from the outside.

The LROI 29 moves in the direction of the arrow $\delta$, the direction $\delta$ being defined between the stationary axle 30 and the projecting stud 30*a* of the link rod 29. Under the action of the pivoting of the child lock lever 31 on the axis 32 in the direction of arrow $\epsilon$ in FIG. 4B, the LROI 29 pivots in the direction of the arrow $\gamma$ in FIG. 4 about the stationary axle 30.

The compartment B also comprises a lever for opening from the outside (LOO) 33 which is articulated at its centre on a fixed axle 34 secured to the lock housing. One end 33*a* of the LOO 33 projects from the housing 15 of the second compartment B in the transverse direction of the door, to catch, in an articulated manner, on a curved end of a linkage 35 for opening from the outside, this linkage being depicted in chain line in FIG. 12. Between the axle 34 and the end 33*a* of the LOO 33, there is a curved lug 33*b* intended to come up against a rigid stop 36 of the housing 2 to limit the angular excursion of the LOO 33 in the anticlockwise direction. The opposite end of the LOO 33 to its outwardly projecting end 33*a* is articulated on an axle 37 to a central portion of a link rod for opening from the outside (LROO) 38. The LROO 38 at one end has a fork 38*a* in which the protruding stub 20*b* of the wheel 20 engages, the fork 38*a* lying between the wheel 20 and the bottom 2*a* of the housing 2.

The opposite end of the LROO 38 has a stepped part 38*b* which is intended to come into contact with the active portion 13 of the pawl 5 and push it into the retracted position, as explained later. Under the action of the linkage 35 for opening from the outside, the LOO 33 pivots on its stationary axle 34 in the direction of the arrow $\alpha'$ which has the effect of causing a translational movement in a roughly vertical direction of the LROO 38 over a distance indicated by the arrow $\beta'$ in FIG. 4. The fork 38*a* of the LROO 38 allows the LROO 38 to slide in the direction $\beta'$ with respect to the stub 20*b* of the wheel 20.

When the wheel 20 turns in the direction of the double arrow $\gamma'$ in FIG. 4, the stub 20*b* causes the LROO 38 to pivot about its fixed axle 37 in the direction of the arrow $\alpha''$ to cause the LROO 38 to engage with/disengage from the active portion 13 of the pawl 5, as explained later.

Figure 4A:
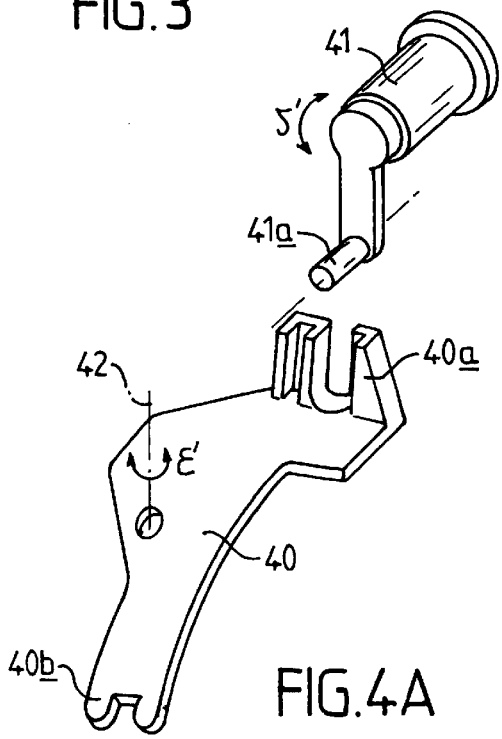
FIG. 4A is a diagrammatic exploded perspective view showing the connection between a barrel toggle and the toggle operating lever of FIG. 4.
Figure 4B:
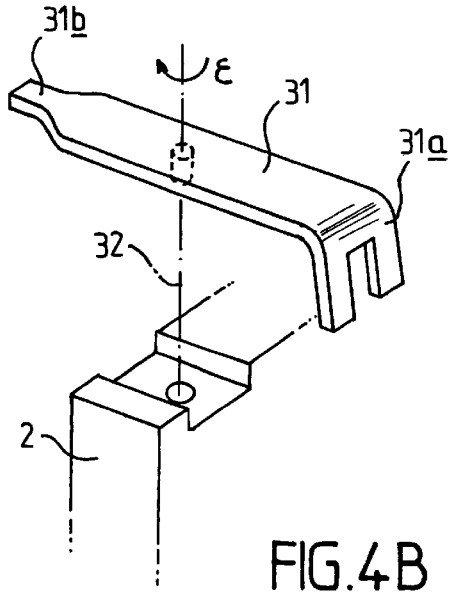
FIG. 4B is a diagrammatic exploded perspective view illustrating the connection between the child lock lever and the housing of the lock of FIG. 4.

The compartment B of the lock further comprises a toggle operating lever (TOL) 40, an end portion 40*a* of which protrudes from the lock housing and is in the shape of a fork bent in the longitudinal direction of the door to cooperate with an eccentric post 41*a* of a lock barrel toggle 41 (see FIG. 4A). The TOL 40 is articulated at an intermediate point on a fixed axle 42 on the bottom 15*a* of the housing 15. The opposite end 40*b* of the TOL 40 relative to the axle 42 is in the shape of a fork cooperating with the protruding stub 20*c* of the wheel 20, on the opposite side to the stub 20*b,* so that the TOL 40 does not interfere with the LROO 38. Under the action of an angular movement of the post 41*a* of the toggle 41 in the direction of the double arrow $\delta'$ in FIG. 4A, the TOL 40 pivots in the direction of the double arrow $\epsilon'$ so that one of the branches of the fork 40*b* cooperates with the stub 20*c* of the wheel 20. The branches of the fork 40*b* are angularly spaced in such a way as to allow the stub 20*c* the freedom to effect a circular translational movement in the direction of the double arrow $\gamma'$ when the wheel 20 is rotated by the driveshaft 21 or by the intermediate lever 22.

In the case of a rear door lock, the TOL 40 may be omitted or left in place, immobile, in the absence of a toggle 41.

In the compartment B, on the bottom 2*a* of the housing 2, there is a housing 43 for a door-open detector (not depicted).

Figure 6:
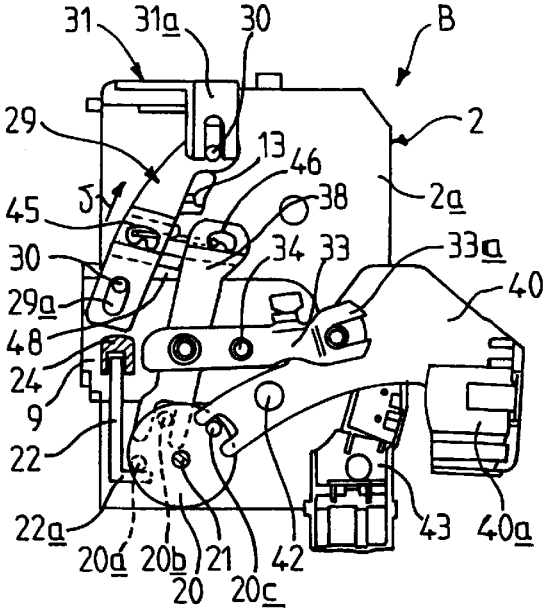
FIG. 6 is a smaller view similar to FIG. 4, showing the further travel of the link rod for opening from the inside for moving the link rod for opening from the outside into the locked position, in accordance with the third subject of the invention.
Figure 6A:
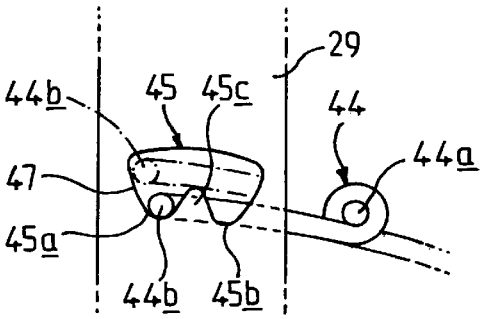
FIG. 6A is a partial and enlarged diagrammatic view of a detail of FIG. 6, depicting the unstable position of the link rod for opening from the inside during the further travel of the child lock lever.

Referring now more specifically to FIGS. 4 and 6A, there can be seen a spring wire 44 wound at its centre around a fixed point 44*a* on the bottom 2*a* of the housing 2, and the two opposite ends 44*b* of which engage respectively in a housing 45, 46 formed in the link rods 29 and 38. As the way in which the spring 44 operates is roughly symmetric for each link rod 29, 38, the operation of the spring 44 will be explained in detail only with reference to the LROI 29, as visible in FIG. 6A. When the LROI 29 moves in the direction of the arrow δ under the action of the LOI 24, the end 44*b* of the spring 44 is urged elastically upwards, which causes the elastic return of the LROI 29 to its position of rest when the user releases the internal door handle.

The housing 45 has two notches 45*a*, 45*b* spaced apart by a small bump 45*c* to define two stable positions of the link rod 29 in the direction of the arrow γ. Thus, when the child lock lever 31 is in the position illustrated in FIG. 4, the end 44*b* of the spring 44 is located in the notch 45*a* furthest from the fixed point 44*a*, to define a stable position in which the link rod 29 is engaged with the active portion 13 of the pawl 5. When the child lock lever 31 is moved in the direction of the arrow ϵ, the link rod 29 moves in the direction of the arrow γ, which brings the end 44*b* of the spring 44 into the second notch 45*b* closest to the fixed point 44*a* of the spring 44, to define a stable position in which the link rod 29 is disengaged from the pawl 5, as visible in FIG. 5. The housing 46 of the LROO 38 also has two similar notches for defining two stable positions in which the link rod 38 is engaged with or disengaged from the pawl 5 when the LROO 38 pivots in the direction of the arrow α".

The housing 45 of the LROI 29 differs from the housing 46 of the LROO 38 by the fact that this housing 45 has a ramp 47 extending from the notch 45*a* some distance from the fixed point 44*a* of the spring 44, to define an unstable position of the link rod 29 when this link rod is moved through a further travel of the child lock lever 31. The unstable position of the end 44*b* of the spring 44 is illustrated in chain line in FIG. 6A, the end 44*b* coming to rest against the ramp 47. This unstable position of the link rod 29 is also illustrated in FIG. 6.

Figure 5:
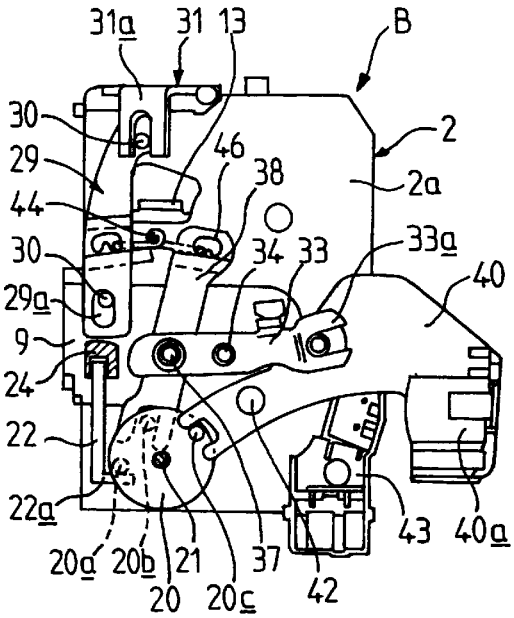
FIG. 5 is a smaller view similar to FIG. 4, showing the link rod for opening from the inside in the position in which it is disengaged by the child lock lever, in accordance with the second subject of the invention.

As visible in FIG. 6, when the child lock lever 31 is moved through its further travel, the link rod 29 inclines towards the link rod 38, in such a way that a protruding portion 48 of the link rod 29 comes into contact with the LROO 38 to push it into its disengaged position. The protruding portion 48 of the LROI 29 has the effect of pivoting one end 44*b* of the spring 44 from one notch to the other in the housing 46 of the LROO 38. In FIG. 6, it can be seen that the child lock lever 31 is pivoted to the right, beyond the engaged position of the link rod 29 of FIG. 4, but it is possible, as an alternative, to envisage for the child lock lever 31 to pivot to the other side beyond the disengaged position of the link rod 29 illustrated in FIG. 5, for example by having the protruding portion 48 of the link rod 29 located on the other side of the fixed axle 30 of the link rod 29 to push the LROO 38 into its disengaged position. It will be noted that, in FIG. 6, the LROI 29 remains in the engaged position during the further travel.

Figure 9:
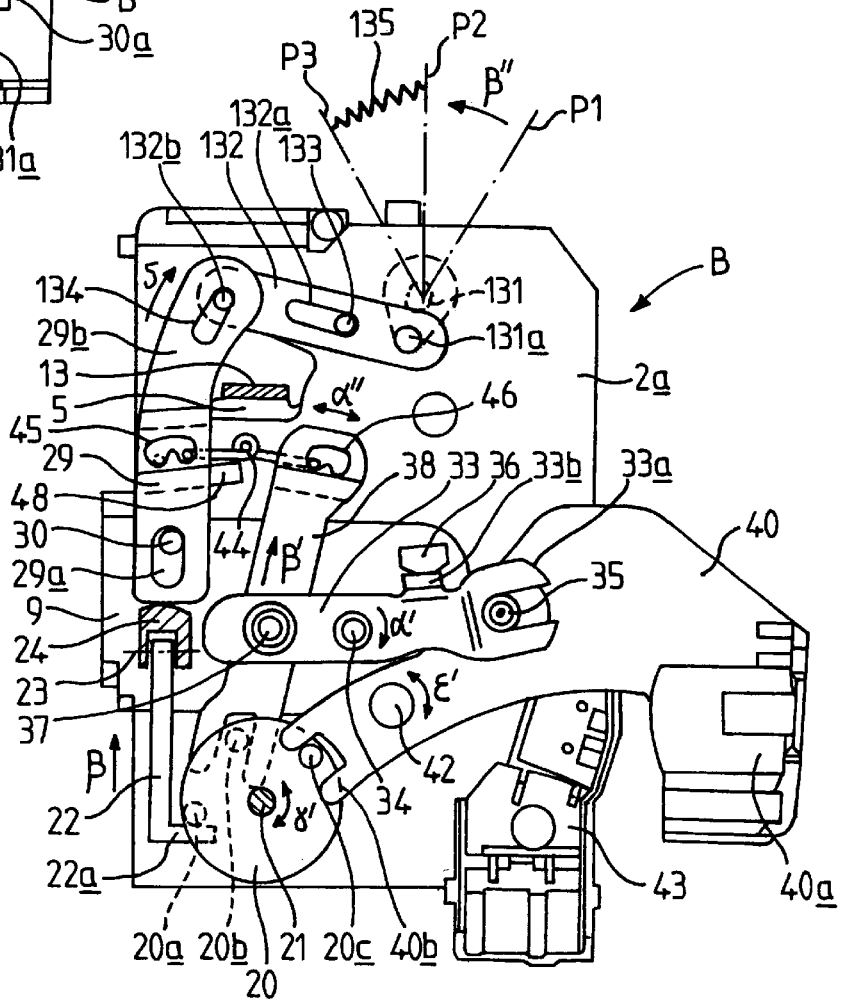
FIG. 9 is a view similar to FIG. 5 but depicting an alternative form of the second and third subjects of the invention.

FIG. 9 depicts an alternative form of the child lock function in the compartment B. The child lock lever 31 is replaced here by a child lock knob 131 (depicted in broken line) accessible on the edge of the door, this knob 131 being secured to an excentric portion 131*a* which is articulated on an intermediate lever 132 which has a central oblong slot 132*a* in which there slides an axle 133 which is fixed with respect to the bottom 2*a* of the housing 2, the opposite end of the intermediate lever 132 comprising a stub 132*b* which engages in sliding manner in an oblong slot 134 formed on the stepped end portion 29*b* of the LROI 29 to allow the opening travel of the LROI 29. In the position illustrated in FIG. 9, the LROI 29 is in its disengaged position, that is to say in the position in which the child lock is on from the inside. This disengaged position of the link rod 29 corresponds to an inclined position P1 of the child lock knob 131, with the fixed axle 133 at one end of the oblong slot 132*a* of the intermediate lever 132. To switch into the unlocked position, with the LROI 29 in the engaged position, it is necessary merely to turn the knob 131 in the direction of the arrow β" into an intermediate position P2 in which the stationary axle 133 is mid-way along the oblong slot 132*a*. Finally, to move the LROI 29 towards the LROO 38, in order to move the latter into the locked disengaged position, it is necessary merely to continue to turn the knob 131 over a further travel beyond the intermediate position P2 into a position P3 which corresponds to the stationary axle 133 being located at the other end of the oblong slot 132*a* of the intermediate lever 132. A return spring 135 may be provided for returning the rotary knob 131 from position P3 to position P2.

Of course, it would also be possible, as an alternative, to envisage a child lock means which was not accessible on the edge of the door but which was actuated by an additional electric motor, the child lock command being given by a knob located, for example, on the dashboard at the front of the cabin.

A description of the third compartment C which contains the elements needed for the electric actuator will now be given with reference to FIGS. 1 and 10 to 12. The actuator comprises a reversible electric motor 50 with two tabs 51 and 52, the respective ends 51*a*, 52*a* of which are curved in the longitudinal direction of the door and act as pins for connecting to the electric power supply from the vehicle battery. The pins 51*a* and 52*a* are located in a housing 53 formed in a casing 54 which, together with the bottom 15*a* of the housing 15 defines the compartment C. This housing 53 is also designed to accommodate a connection block 55, as illustrated in FIG. 11.

The electric motor 50 comprises, on the opposite side to the tabs 51 and 52, an externally protruding driveshaft 56 which is secured to a drive pinion 57, the latter meshing tangentially with a gearwheel 58 which is secured to and coaxial with the driveshaft 21 and extends at right angles to the drive shaft 56.

Figure 11:
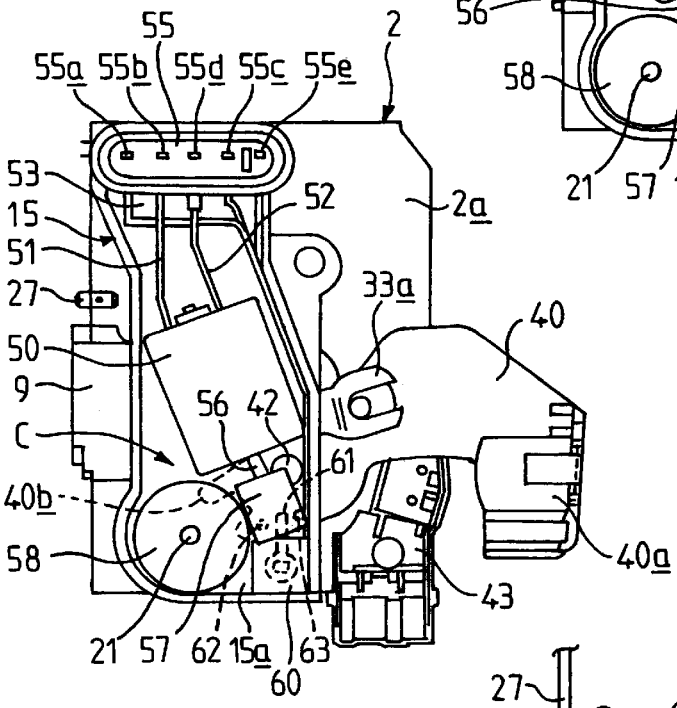
FIG. 11 is a view similar to FIG. 10, but depicting an alternative form of the third compartment for the actuator.

In the alternative form of FIG. 11, the compartment C may further contain a three-position switch 60, this switch comprising a trigger arm 61 depicted in broken line which is intended to pivot about its central position of equilibrium under the action of two stop posts 62, 63 located on the TOL 40 when the latter is pivoted by the toggle 41 of the barrel. Depending on whether the trigger arm 61 is pivoted to the right or to the left, respective information about unlocking or locking is transmitted, via the terminal block 55, to the other door locks of the vehicle.

Figure 10:
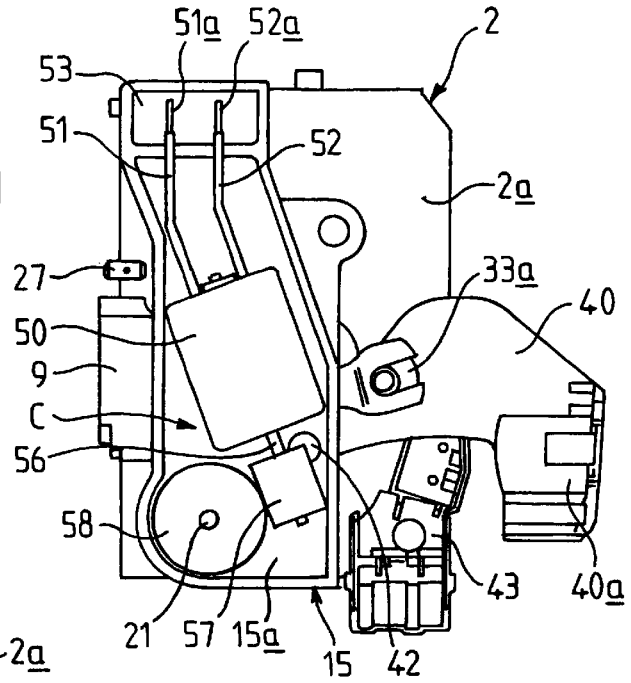
FIG. 10 is a view taken along line X of FIG. 1, the casing of the third compartment having been omitted.
Figure 12:
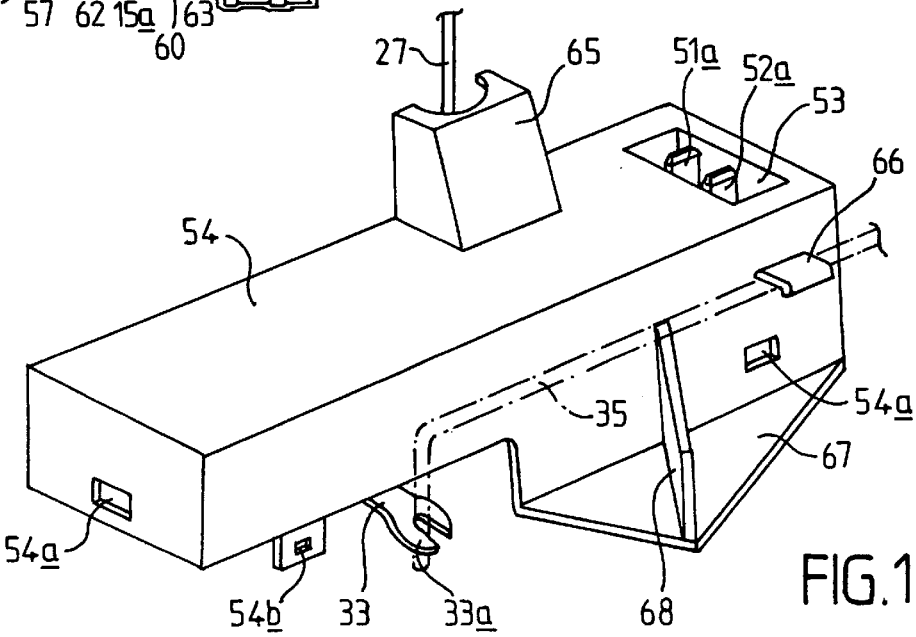
FIG. 12 is a perspective view from above the casing of the lock in accordance with the fourth subject of the invention, intended to cover the third compartment illustrated in FIG. 10 or 11.

On the block 55, which replaces the pins 51*a* and 51*b* of FIGS. 10 and 12, have been marked, as 55*a* and 55*b*, the power terminals of the electric motor 50, as 55*c*, the positive terminal of the switch 60, and as 55*d* and 55*e*, the respective output terminals for the locked and unlocked signal to the other locks.

Referring now to FIGS. 1 and 12, it can be seen that the casing 54 has the shape of a parallelepipedal box which is closed by the bottom 15*a* of the housing 15. 54*a* and 54*b* respectively depict two slots and a lug for securing the casing 54 and the housing 15 together. Protruding outwards in the longitudinal direction of the door from the flat bottom of the casing 54 is a hollow chimney 65 intended to protect the linkage or cable 27 for opening from the inside against any attempt at catching hold of it from the outside, given that this linkage or cable 27 for opening from the inside allows the link rod 38 for opening from the outside to be unlocked, thanks to the intermediate lever 22.

On a vertical longitudinal wall of the casing 54 there is a lug 66 for temporarily securing the linkage 35 for opening from the outside. This same wall of the casing 54 is extended towards the second compartment B of the lock and ends in a lug 67 which is curved outwards in a plane roughly parallel to the plane of the bottom of the casing 54. A deflector fin 68 extends between the said longitudinal wall of the casing and the curved lug 67 in a direction inclined downwards and towards the outside of the lock, to guide the flow of water that has come from the door window seal away from the lock.

The operation of the lock of the invention will now be described briefly.

In the case of a front door lock, the user can lock/unlock the lock either using a remote control electronic unit to activate the electric motor 50 which rotates the wheel 20 or using a key in the lock barrel which causes the toggle operating lever 40 to pivot, causing the wheel 20 to rotate.

As an alternative, the unlocked signal received by the electric actuator may be emitted by recognition electronics, not depicted, forming part of a "hands free keyless entry" system known per se which requires neither the use of a key nor the use of a remote control to unlock the lock. In this system, the recognition electronics are equipped with a radio transmitter and are designed to be able to dialogue with a radioelectric device incorporated into a wristwatch or a card or a badge on the user's person. The recognition electronics produce their unlock signal only once correct ownership has been identified.

In the position illustrated in FIG. 4, the lock is locked as far as opening from the outside is concerned because the LROO 38 is in the position in which it is disengaged from the active portion 13 of the pawl 5. When the motor 50 of the actuator rotates the wheel 20 in the clockwise direction, the post 20*b* causes the LROO 38 to pivot in the direction $\alpha''$ over a short travel until the stepped portion 38*b* of the LROO 38 is in the position engaged with the active portion 13 of the pawl 5. As the wheel 20 rotates under the action of the actuator, the pin 20*c* moves between the branches of the fork 40*b* of the TOL 40 without moving the latter, and the post 20*a* moves away from the curved portion 22*a* of the lever 22.

If the user wishes to unlock the lock using his key, the toggle 41 of the barrel causes the TOL 40 to pivot in the anticlockwise direction, which causes the post 20*c* to be moved by one of the branches of the fork 40*b* and therefore causes the wheel 20 to rotate, which at the same time, via the post 20*b,* causes the LROO 38 to pivot into its unlocked engaged position. If the lock was already in an unlocked state, the TOL 40 would act without producing an effect, because the post 20*c* would have already been moved in the clockwise direction.

When the LROO 38 pivots into its engaged position, the end 44*b* of the spring 44 will move from one notch to the other in the housing 46 so that the LROO 38 will be in an engaged stable position.

Figure 2:
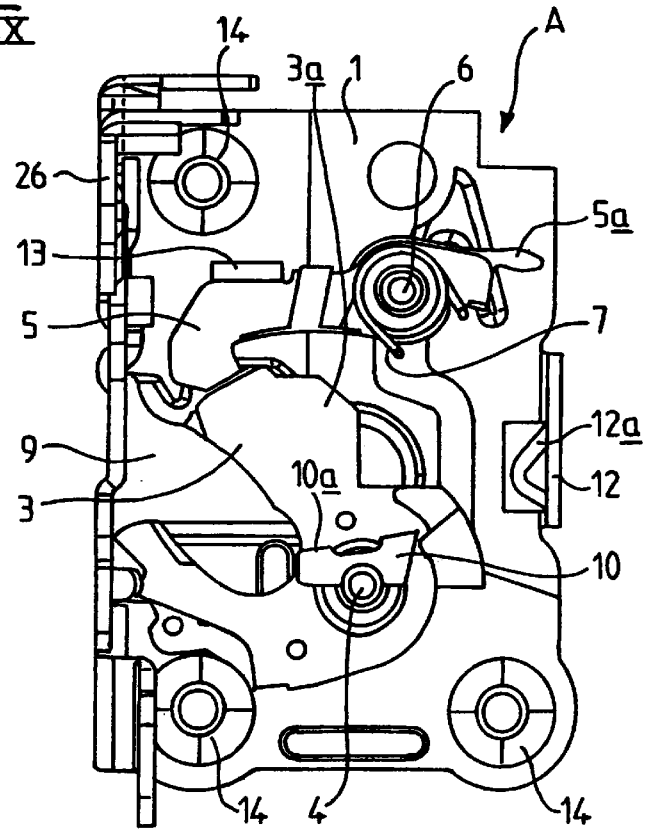
FIG. 2 is a view in section of the first compartment of FIG. 1, on the line II, after a rotation through 180°.

Once the lock has been unlocked as far as opening from the outside is concerned, the user can open the door by acting on the external door handle which, via the linkage 35 for opening from the outside will cause the LOO 33 to pivot in the clockwise direction and therefore cause the LROO 38 to rise in the direction of the arrow $\beta'$ and thus lift the active portion 13 of the pawl 5 and release the latch 3 which will automatically pivot into the position illustrated in FIG. 2 under the effect of the compressive force of the door seal, the door striker 8 being somewhat ejected from the slot 9.

Assuming now that the user is inside the cabin of the vehicle, with the locks in the locked position as far as opening from the outside is concerned, as illustrated in FIG. 4, he can, by acting on the internal door handle, cause the LOI 24 to pivot which will simultaneously cause the door to open, by virtue of the LROI 29 which will move the pawl 5 and unlock the door as far as opening from the outside is concerned, by virtue of the intermediate lever 22 which causes the wheel 20 to rotate in the clockwise direction acting on the post 20*a.* In effect, in a front door lock, the LROO 29 has always to be repositioned in its engaged position at the same time as the door is opened from the inside, for safety reasons: this is the over-ride function.

In a rear door lock, it is not possible to act on the TOL 40, because the rear doors do not have barrels. Consequently, to unlock the rear doors from the outside, the user has to act on his remote control electronics unit or use recognition electronics which transmit the unlocking information to all the door locks of the vehicle, the rear door locks being unlocked by virtue of the electric motor 50 of the actuator specific to each lock.

In the case of a rear door lock, the user will have moved the child lock lever 31 into the position of FIG. 5, for reasons of safety with respect to children. To do this, he may push the end 31*b* of the child lock lever which is accessible on the edge of the door. In the position of FIG. 5, the LROI 29 is in a position which is disengaged from the pawl, so that a child acting on the internal door handle will not be able to cause the door to open. What happens is that although there is nothing preventing the LOI 24 or the LROI 29 from moving, the latter item will move but have no effect beside the active portion 13 of the pawl 5. However, by acting on the internal door handle, the child will at the same time cause the lock to be unlocked as far as opening from the outside is concerned, by virtue of the intermediate lever 22 which rotates the wheel 20 in the clockwise direction, acting on the post 20*a,* which will allow somebody outside to open the rear door. Of course, if the rear door lock is already in an unlocked position as far as opening from the outside is concerned, the intermediate lever 22 will act but have no effect because the post 20*a* will have already rotated through the necessary travel.

Let us assume now that all the vehicle energy sources are flat or unserviceable and that the user wishes to lock all the doors of the vehicle before leaving it to seek assistance, while the rear door locks are in an unlocked position as far as opening from the outside is concerned. In the case of the front door locks, he can lock these by acting on the barrel using his key, but in the case of the rear doors, he cannot lock the locks without a lock stalk.

This being the case, by acting on the child lock lever 31, so as to move it through its further travel which causes the LROI 29 to move towards the LROO 38, as illustrated in FIG. 6, he will be able to pivot the LROO 38 into the disengaged position. The user will then need to do no more than slam the rear door shut in order to lock it as far as opening it from the outside is concerned.

When he returns to his vehicle, he will be able to unlock the front doors using his key and then acting on the internal rear door handle from the inside the vehicle cabin, he will be able also to unlock the lock as far as opening from the outside is concerned, then open the rear door using the external door handle and, using the child lock lever 31, pivot the LROI 29 into its engaged position, if he wishes to remove the child lock.

Although the invention has been described in conjunction with a number of particular embodiments of the invention, it is obvious that it is not in any way restricted thereto and that it comprises all technical equivalents of the means described, and combinations thereof if these fall within the scope of the invention.

What is claimed is:

1. Motor vehicle door lock comprising a means of locking/unlocking the lock from the outside, an electric actuator (50) for controlling the said means of locking/unlocking from the outside, a wheel (20) which can be rotated by the electric actuator (50), a lock pawl (5) blocking a lock latch (3) at rest in a position which can retain a door striker (8) in a door-closed position, and a link rod (38) for opening from the outside capable of moving, under the action of an external door handle, along a door-opening travel (β') to come into contact with an active portion (13) of the said pawl (5) to move said pawl into a retracted position releasing the latch (3), which allows the door to be opened, characterized in that the said wheel is a central locking/unlocking wheel (20) with which all the control means (38,40) for locking/unlocking the lock from the outside cooperate, the said wheel (20) cooperating with the link rod (38) for opening from the outside to move the link rod, as the said wheel rotates, between an engaged stable position in which the link rod for opening from the outside is able to come into contact with the said active portion (13) of the pawl, during the door-opening travel (γ') of said link rod, and a disengaged stable position in which the link rod for opening from the outside is no longer able to come into contact with the pawl (5) during the door-opening travel of said link rod.

2. Lock according to claim 1, characterized in that the said wheel (20) cooperates with a toggle operating lever (40) which is able to rotate the said wheel under the action of a lock barrel toggle (41) to move the link rod (38) for opening from the outside between the disengaged and engaged positions of said link rod.

3. Lock according to claim 2, characterized in that the toggle operating lever (40) is coupled to the said wheel (20) with freedom of circular movement that corresponds to the angular travel of the said wheel under the action of the actuator (50) so that an unlocking/locking movement (γ') of the wheel under electric control of the actuator does not interfere with an unlocking/locking movement of the wheel under mechanical control of the barrel, the toggle operating lever (40) having two positions of simple contact with the said wheel (20) to move said wheel either into an unlocking position when said wheel is in a locking position or into the locking position when said wheel is in the unlocking position.

4. Lock according to claim 3, characterized in that the connection between the toggle operating lever (40) and the said wheel (20) is formed by the coupling of a fork **(40*b*) with a protruding stub (20*c*), the branches of the said fork being spaced apart by a distance that corresponds to the angular travel of the wheel under the action of the actuator (50)**.

5. Lock according to claim 1, characterized in that the link rod (38) for opening from the outside is coupled to the wheel with freedom to move in the direction of the opening travel (β') of the said link rod.

6. Lock according to claim 1 characterized in that said lock comprises a link rod (29) for opening from the inside, and a lever (24) for opening from the inside for moving said link rod (29) for opening from the inside under the action of an internal door handle, into contact with said active portion (13) of the pawl (5) to move said pawl into a retracted position, the said lever for opening from the inside cooperating, in a door-opening travel (α) of said lever for opening from the inside, with the said wheel (20) to rotate said wheel into an unlocking position.

7. Lock according to claim 6, characterized in that the lever (24) for opening from the inside cooperates with the said wheel through a simple contact **(22*a*)** only causing the said wheel to move into said unlocking position, the lever for opening from the inside being returned to a position of rest independently of the said wheel.

8. Lock according to one of claim 1, characterized in that the wheel (20) is planar and has a number of stubs **(20*a*, 20*b*, 20*c*) protruding at right angles to the plane of said wheel to cooperate with the means (38, 40)** of controlling locking and/or unlocking from the outside.

9. Lock according to claim 1, characterized in that the actuator consists of an electric motor (50), a driveshaft (56) of which rotates a drive pinion (57) which meshes tangentially with a gearwheel (58), a rotation axle (21) of which is perpendicular to the axis of the pinion and secured to the aforementioned central locking/unlocking wheel (20).

10. Lock according to claim 2, characterized in that the actuator (50) is connected to a three-position switch (60) which comprises a trigger arm (61) pivoting between two stops (62, 63) which are positioned on the toggle operating lever (40) to transmit locking/unlocking information to the actuator of another lock.

11. Lock according to claim 2, wherein the link rod for opening from the outside is coupled to the wheel with freedom to move in the direction of the opening travel of the link rod.

12. Lock according to claim 3, wherein the link rod for opening from the outside is coupled to the wheel with freedom to move in the direction of the opening travel of the link rod.

13. Lock according to claim 4, wherein the link rod for opening from the outside is coupled to the wheel with freedom to move in the direction of the opening travel of the link rod.

14. Lock according to claim 2, which comprises a link rod (29) for opening from the inside, and a lever for opening from the inside for moving said link rod for opening from the inside under the action of an internal door handle, into contact with said active portion of the pawl to move said pawl into a retracted position, the lever for opening from the inside cooperating, in a door-opening travel (α) of said lever for opening from the inside, with the wheel to rotate said wheel into an unlocking position.

15. Lock according to claim 3, which comprises a link rod (29) for opening from the inside, and a lever for opening from the inside for moving said link rod for opening from the inside under the action of an internal door handle, into contact with said active portion of the pawl to move said pawl into a retracted position, the lever for opening from the inside cooperating, in a door-opening travel (α) of said lever for opening from the inside, with the wheel to rotate said wheel into an unlocking position.

16. Lock according to claim 4, which comprises a link rod (29) for opening from the inside, and a lever for opening from the inside which for moving said link rod for opening from the inside under the action of an internal door handle, into contact with said active portion of the pawl to move said pawl into a retracted position, the lever for opening from the inside cooperating, in a door-opening travel (α) of said lever for opening from the inside, with the wheel to rotate said wheel into an unlocking position.

17. Lock according to claim 5, which comprises a link rod (29) for opening from the inside, and a lever for opening from the inside for moving said link rod for opening from the inside under the action of an internal door handle, into contact with an active portion of the pawl to move said pawl into a retracted position, the lever for opening from the inside cooperating, in a door-opening travel (α) of said lever for opening from the inside, with the wheel to rotate said wheel into an unlocking position.

18. Lock according to claim 2 wherein the wheel has a number of stubs protruding at right angles to its plane to cooperate with the various means of controlling locking and/or unlocking from the outside.

19. Lock according to claim 3 wherein the wheel has a number of stubs protruding at right angles to its plane to cooperate with the various means of controlling locking and/or unlocking from the outside.

20. Lock according to claim 4 wherein the wheel has a number of stubs protruding at right angles to its plane to cooperate with the various means of controlling locking and/or unlocking from the outside.

* * * * *